US010464115B2

(12) United States Patent
Aigner et al.

(10) Patent No.: US 10,464,115 B2
(45) Date of Patent: Nov. 5, 2019

(54) BENDING PRESS HAVING BENDING UNIT, AND RESHAPING METHOD

(71) Applicant: TRUMPF Maschinen Austria GmbH & Co. KG., Pasching (AT)

(72) Inventors: Wolfgang Aigner, Sattledt (AT); Stefano Speziali, Foligno (IT); Thomas Weiss, Linz (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 528 days.

(21) Appl. No.: 15/319,155

(22) PCT Filed: May 21, 2015

(86) PCT No.: PCT/AT2015/050130
§ 371 (c)(1),
(2) Date: Mar. 10, 2017

(87) PCT Pub. No.: WO2015/188208
PCT Pub. Date: Dec. 17, 2015

(65) Prior Publication Data

US 2017/0189951 A1 Jul. 6, 2017

(30) Foreign Application Priority Data

Jun. 10, 2014 (AT) ..... A 50398/2014

(51) Int. Cl.
*B21D 5/04* (2006.01)
*B21D 7/06* (2006.01)
*B21D 7/02* (2006.01)

(52) U.S. Cl.
CPC ..... *B21D 5/045* (2013.01); *B21D 5/042* (2013.01); *B21D 7/02* (2013.01); *B21D 7/06* (2013.01)

(58) Field of Classification Search
CPC ..... B21D 5/04; B21D 5/042; B21D 5/045; B21D 5/047; B21D 5/01; B21D 5/002;
(Continued)

(56) References Cited

U.S. PATENT DOCUMENTS 4,843,862 A 7/1989 Salvagnini
4,944,176 A 7/1990 Glorieux et al.
(Continued)

FOREIGN PATENT DOCUMENTS

DE 932903 C * 9/1955 ..... B21D 11/203
DE 3 837 603 A1 5/1990
(Continued)

OTHER PUBLICATIONS

International Search Report of PCT/AT2015/050130, dated Sep. 9, 2015.

*Primary Examiner* — Pradeep C Battula
(74) *Attorney, Agent, or Firm* — Collard & Roe, P.C.

(57) ABSTRACT

The invention relates to a bending press (3) and to a method for bending sheet metal in relation to a work piece (2). The bending press (3) comprises a machine frame (7) on which lower and upper clamping jaws (5, 6) are arranged, having first and second reshaping edges. A bending tool (41) having a bending edge (42) is arranged on a bending bar (43). The bending tool (41) is mounted about a swivel axis (46) such that same can swivel. The swivel axis (46) can be moved into both a position above and a position below a work piece contact plane (40). In a position above the work piece contact plane (40), the bending edge (42) is oriented downwards in the direction of a first reshaping edge, and in a position below the work piece contact plane (40), said bending edge is oriented upwards in the direction of the
(Continued)

second reshaping edge. The invention also relates to a method for reshaping, in particular bending, sheet metal in relation to a work piece (2).

16 Claims, 4 Drawing Sheets

(58) Field of Classification Search
CPC ..... B21D 11/22; B21D 11/203; B21D 7/02; B21D 7/04; B21D 7/06
See application file for complete search history.

(56) References Cited

U.S. PATENT DOCUMENTS

| | | | | | |
|---|---|---|---|---|---|
| 5,743,128 | A | | 4/1998 | Liet | |
| 5,842,369 | A | * | 12/1998 | Kutschker ..... | B21D 5/04 72/319 |
| 6,363,766 | B1 | | 4/2002 | Kunze | |
| 6,427,511 | B1 | | 8/2002 | Kutschker et al. | |
| 2003/0070463 | A1 | | 4/2003 | Kunze | |

FOREIGN PATENT DOCUMENTS

| | | | | | |
|---|---|---|---|---|---|
| DE | 3837603 | A1 | * | 5/1990 | ..... B21D 5/042 |
| DE | 4 019 881 | A1 | | 1/1992 | |
| DE | 9111219 | U1 | * | 1/1992 | ..... B21D 5/042 |
| DE | 4034248 | A1 | * | 4/1992 | ..... B21D 5/042 |
| DE | 9 404 308 | U1 | | 7/1994 | |
| EP | 0 293 964 | A2 | | 12/1988 | |
| EP | 0 338 949 | A1 | | 10/1989 | |
| EP | 0 679 456 | A1 | | 11/1995 | |
| EP | 0 745 442 | A1 | | 12/1996 | |
| EP | 1 057 548 | A2 | | 12/2000 | |
| EP | 1 121 996 | B1 | | 8/2001 | |
| EP | 1 302 252 | A1 | | 4/2003 | |
| EP | 1797973 | A1 | * | 6/2007 | ..... B21D 5/0209 |
| JP | S57 4322 | A | | 1/1982 | |
| JP | 02155515 | A | * | 6/1990 | ..... B21D 5/042 |
| JP | 11123461 | A | * | 5/1999 | ..... B21D 5/045 |
| JP | 2001 191118 | A | | 7/2001 | |
| SU | 1766555 | A1 | | 10/1992 | |
| WO | WO-9200154 | A1 | * | 1/1992 | ..... B21D 5/042 |
| WO | 00/43140 | A1 | | 7/2000 | |

* cited by examiner

BENDING PRESS HAVING BENDING UNIT, AND RESHAPING METHOD

CROSS REFERENCE TO RELATED APPLICATIONS

This application is the National Stage of PCT/AT2015/050130 filed on May 21, 2015, which claims priority under 35 U.S.C. § 119 of Austrian Application No. A 50398/2014 filed on Jun. 10, 2014, the disclosure of which is incorporated by reference. The international application under PCT article 21(2) was not published in English.

The invention relates to a bending press and a reshaping method, in particular bending, of a metal sheet into a workpiece, as described in claims 1 and 12.

From EP 0 679 456 A1 a bending press is known with a bending unit for bending a metal sheet into a workpiece, in which the bending tool is connected to an angle measuring device for determining its position relative to the bending bar. The bending press comprises a fixed machine frame, a lower clamping bar with at least one lower clamping jaw mounted thereon, which at least one clamping jaw comprises a first forming edge and an upper clamping bar. On the upper clamping bar at least one upper clamping jaw is mounted, which at least one clamping jaw comprises a second forming edge. The upper clamping bar is adjustable on a clamping bar guide by means of a drive arrangement relative to the machine frame in order to clamp the workpiece to be produced between the two clamping jaws. The at least one lower clamping jaw comprises a lower clamping surface at its end section facing the upper clamping jaw. The at least one upper clamping jaw comprises an upper clamping surface at its end section facing the lower clamping jaw, wherein the two clamping surfaces in a position bearing against one another define a workpiece bearing plane for the workpiece to be produced.

The bending unit comprises bending tools which comprise a bending edge. Furthermore, the bending tools are arranged on a bending bar, wherein the bending bar can be adjusted relative to the machine frame on bending bar guides designed as linear guides by means of a bending bar drive. The bending tools can be pivoted about a pivot axis aligned parallel to one of the forming edges. The bending bar has a C-shaped cross-section, wherein the bending tool is arranged pivotably on two limbs on the inner side respectively. Thus a separate bending tool is necessary for both folding directions.

DE 38 37 603 A1 describes a metal sheet bending machine with an upper beam movable in vertical direction and a bending table supporting the workpiece. The workpiece is either bent by a pivot movement of a bending beam with a bending tool mounted thereon about a bending pivot axis or is bent by means of a shearing bending process by a smooth height adjustment of the bending beam. The bending pivot axis for the bending beam is arranged in front of the bending edge of the bending table or in front of the upper beam depending on the material strength of the workpiece. The bending beam is pivoted in a fixed radius about the bending pivot axis for the bending process, wherein depending on the bending direction and the associated arrangement of the bending beam either above the workpiece or below the workpiece the bending tool held pivotably on the bending beam is pivoted accordingly. During the shearing bending process the bending beam is moved together with the bending tool in a plane perpendicular to the bending table. For the shearing bending process with bending beam located underneath the workpiece the bending tool projects upwards towards the workpiece. If a shearing bending process is performed from the top to the bottom, the bending beam needs to be pivoted by 180°, so that the latter is located above the bending table and thus the workpiece. By means of the pivoting movement of the bending beam there is an alignment of the bending tool downwards in the direction of the workpiece. Then the shearing bending process can be performed from the top to the bottom.

Further bending bars mounted about a pivot axis on a machine frame with bending tools are known from DE 94 04 308 U1, EP 0 293 964 A2, EP 1 121 996 B1 or EP 1 302 252 A1.

The underlying objective of the present invention is to create a bending press comprising a bending unit with a bending tool and to provide a method, by means of which it is possible to perform universal reshaping processes, particularly bending.

Said objective of the invention is achieved by the features of claim 1. The advantage achieved by the features of claim 1 is that it is possible in this way to arrange and align accordingly the pivot axis of one bending tool and its bending edge facing the clamping jaws either above or below the workpiece bearing plane. Thus the bending bar together with the bending tool arranged thereon can be arranged so far apart from the workpiece bearing plane in a direction perpendicular thereto that there is sufficient free space behind the clamping jaws for arranging and/or mounting the workpiece to be reshaped. Thus depending on the bending or folding direction to be followed, the bending tool can be adjusted together with the bending bar supporting the bending tool into a position located on both sides of the workpiece bearing plane. In this way there is no component of the bending unit immediately behind the clamping jaws. Afterwards, the bending tool with its bending edge can be aligned in the direction of the respective forming edge of one of the lower or upper clamping jaws. In this way it is possible to use only one bending tool, wherein by means of the corresponding pivot movement about the pivot axis the bending edge can be aligned to the respective bending direction and/or folding direction. With a further adjustment the reshaping process is performed, in particular the folding process. In this case the limb to be bent is preferably pivoted to the side facing away from the bending tool and thus into the free space behind the clamping jaws.

A further embodiment as claimed in claim 2 is also advantageous, as in this way the transmission of torsion and thus the pivoting movement can be transmitted directly from the bending bar to the bending tool arranged thereon. In this way a double function can be performed by the bending bar designed in the form of a shaft, as on the one hand the latter bears the bending tool and supports it accordingly and on the other hand a pivoting movement is made possible about the pivot axis defined by the shaft for the bending tool.

Furthermore, a configuration as claimed in claim 3 is advantageous, as it is possible thereby to omit additional drive means directly in the region of the bending tool for the latter, as a direct transmission of torque can be performed via the shaft to the bending tool. Thus with a suitably rotationally-secure connection or coupling additional free space can be created for the processing procedures of the workpiece to be produced.

By means of the configuration as claimed in claim 4 it is possible to create a compact component, as in this way the shaft with the pivot drive in drive connection therewith does not require additional adjusting means in the direct vicinity of the bending tool. The transmission of the drive torque can therefore be performed in at least one end section of the shaft arranged spaced apart in a direction of the bending area or the forming edges.

According to another embodiment variant as claimed in claim 5 it is thus possible to fix the bending edge in position relative to the forming edges on the clamping jaws. Thus with a suitably preadjusted angular position of a tool plane clamped by the bending edge and the pivot axis relative to the workpiece bearing plane and/or the bending tool-adjusting plane with a single adjusting movement of the bending bar in the bending tool-adjusting plane an adjustment can be performed with an unchanged angular position.

A development as claimed in claim 6 is also advantageous, as thus an off-center guiding of the bending bar by the pivot axis defined by the latter is avoided laterally next to the bending tool adjusting plane defined by the ending bar guides. In this way a more compact configuration of the bending unit can be created.

In the configuration as claimed in claim 7 it is an advantage that it is thus possible to achieve a more individual configuration of the bending tool. By dividing the bending tool into a plurality of bending tool elements arranged behind one another there can be a more individual adjustment of the whole bending tool to the respectively performed bending and/or folding process.

By means of the development as claimed in claim 8, only those bending tool elements can be moved into the operating position which are absolutely necessary for the bending and/or folding process of the workpiece to be produced. Bending tool elements that are not needed can thus be arranged outside the operating area and yet still remain supported on the bending bar.

By means of the configuration as claimed in claim 9 thus a rigid bending bar designed as an axis can be created for supporting the bending tool or its bending tool elements. An independent pivoting and/or adjusting movement of the individual bending tool elements can thus be performed about the supporting axis. In this way it is possible to achieve an individual adjustment and prepositioning of the individual bending tool elements required for the bending and/or folding process to be performed.

A configuration as claimed in claim 10 is also advantageous, as thus the drive and the rotatory adjustment movement of the individual bending tool elements about the supporting axis can be performed in the smallest possible space.

According to one embodiment, as described in claim 11, sufficient free space can thus also be created for the workpiece to be produced in the region of the workpiece bearing plane behind the clamping jaws. By means of the laterally spaced apart arrangement of the bending bar guides an exact guiding of the bending bar can be achieved and also on the side of the bending bar facing away from the clamping jaws a large free space can still be created for the workpiece to be produced and/or processed.

The objective of the invention is also achieved however independently thereof by a method for reshaping, in particular bending, a metal sheet into a workpiece according to the features specified in claim 12. The advantages resulting from the combination of features of said claim are that it is thus possible to arrange the pivot axis of one bending tool and its bending edge facing the clamping jaws either above or below the workpiece bearing plane and align it accordingly. Thus the bending bar together with the bending tool arranged thereon can be arranged so far from the workpiece bearing plane in a perpendicular direction from the latter that sufficient free space is available behind the clamping jaws for arranging the workpiece to be reshaped. In this way depending on the bending or folding direction to be performed the bending tool can be adjusted together with the bending bar supporting the bending tool into one of the positions located on both sides of the workpiece bearing plane. Afterwards the bending tool with its bending edge can be aligned in the direction of the respective forming edge of one of the clamping jaws. In this way it is possible to use the same bending tool, wherein by means of the corresponding pivot movement about the pivot axis the bending edge can be aligned in the respective bending direction and/or folding direction. By means of the overlayered, simultaneous adjusting and pivot movement of the bending tool it is thus possible to achieve the consistent bearing of the bending edge on the workpiece. In this way surface damage can be almost completely avoided and even excluded.

Furthermore, a procedure according to the features given in claim 13 is advantageous, because in this way it is possible to achieve a slight overbending and/or folding of the limb to be bent. In this way even with resilient spring back the specified bending angle of the limb can still be maintained.

A further advantageous procedure is described in claim 14, whereby a transmission of torsion and thereby the pivot movement can be transmitted directly from the bending bar to the bending tool arranged thereon. In this way a double function can be performed by the bending bar designed as a shaft, as on the one hand the latter bears and supports the bending tool accordingly and on the other hand a pivot movement is made possible about the pivot axis for the bending tool defined by the shaft.

A variant of the method according to claim 15 is also advantageous, because in this way it is possible to avoid having additional drive means directly in the region of the bending tool for the latter, as a direct transfer of torque can be performed via the shaft to the bending tool. Thus with a suitable rotationally secure connection or coupling additional free space can be created for the processing procedures of the workpiece to be created.

In the method steps selected according to claim 16 it is also advantageous that in this way a compact structural unit can be created, as thus the shaft with the pivot drive in drive connection therewith does not need additional adjusting means in the immediate vicinity of the bending tool. The transmission of the drive torque can therefore be performed in at least the end section of the shaft arranged spaced apart in the direction of the bending area or the forming edges.

For a better understanding of the invention the latter is explained in more detail with reference to the following figures.

In a much simplified, schematic view.

Figure 1:
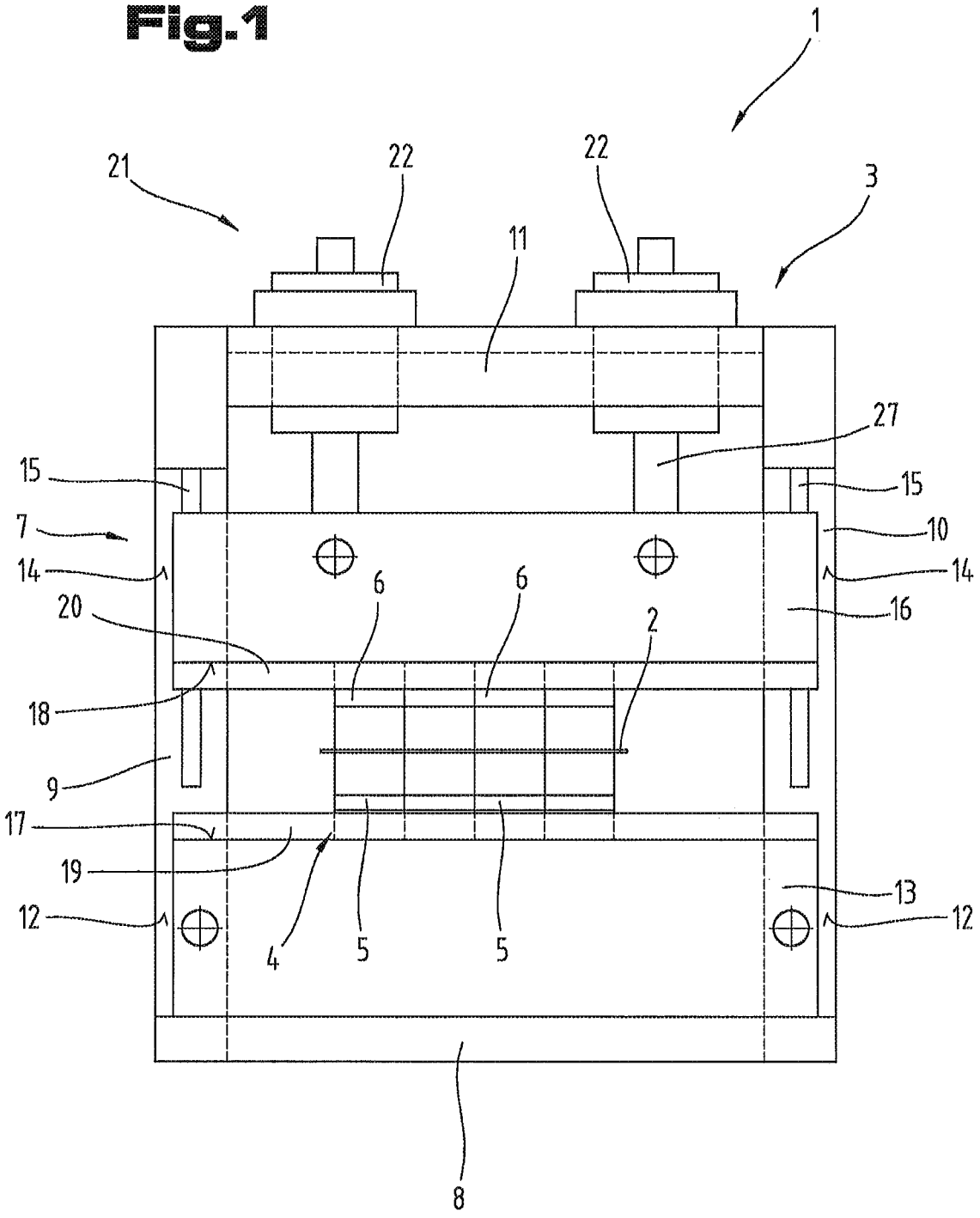
FIG. 1 shows a production facility with a bending press in front view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

Figure 2:
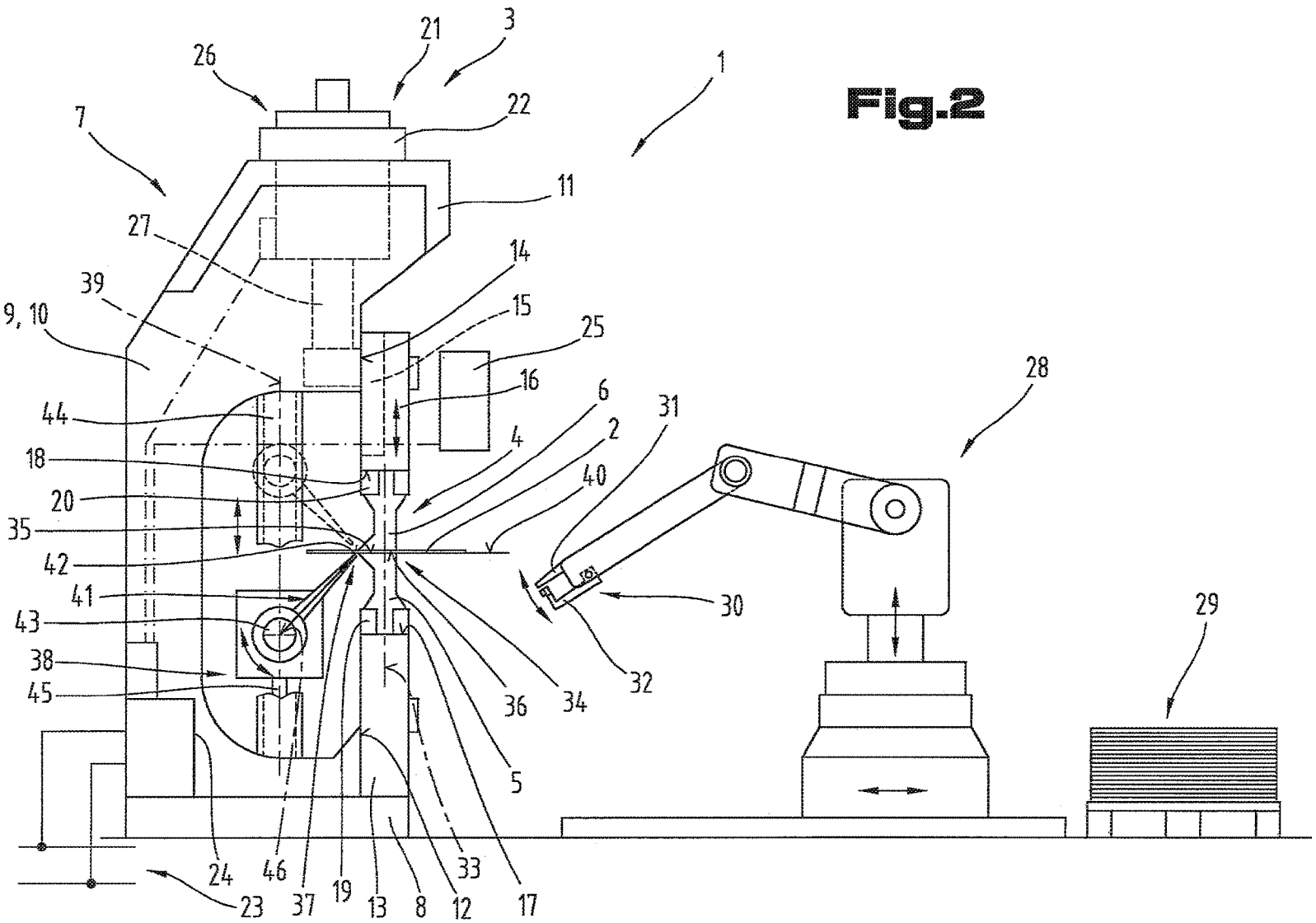
FIG. 2 shows the production facility according to FIG. 1, in side view with a simplified bending unit, in partial cross-section.

In FIGS. 1 and 2 a production facility 1 is shown in a much schematically simplified representation, which in the present case is designed in particular for the pivot bending or swivel bending of workpieces 2 to be made from metal sheet.

The production facility 1 used for bending in the present case comprises a bending press 3, in particular a press which is designed for clamping the workpieces 2 or parts to be made from metal sheet between a clamping tool 4 adjustable relative to one another. The clamping tool 4 comprises in the present example embodiment at least one, but mostly a plurality of lower clamping jaws 5 and at least one, but mostly a plurality of upper clamping jaws 6 interacting therewith. The at least one upper clamping jaw 6 is thus arranged above the workpiece 2 to be produced on the bending press 3 and also held there accordingly, in particular clamped. Also the at least one lower clamping jaw 5 is held on the bending press 3, in particular clamped.

A machine frame 7 of the bending press 3 comprises for example side walls 9, 10 which are aligned rising vertically from a base plate 8 and are spaced apart from another and parallel to one another. The latter are preferably connected to one another by a solid for example transverse bracing 11 made from a metal sheet molding at their end sections spaced apart from the base plate 8. The machine frame 7 is mostly a solid component of the bending press which is preferably fixed to a factory floor.

The side walls 9, 10 can be designed to be preferably approximately C-shaped to form a free space for reshaping the workpiece 2, wherein on the front end faces 12 of limbs of the side walls 9, 10 close to the base a fixed, lower clamping bar 13 standing in particular on the base plate 8 is secured, which can also be referred to as a press bar. Said clamping bar 13 which is arranged to be fixed can also be referred to as a clamping table, on which parts of the bending tool 4 are arranged and also held. On the front end faces 14 on a limb remote from the base plate 8 in clamping guides 15 a further upper clamping bar 16 is guided, in particular a pressure bar which can be adjusted relative to the lower clamping bar 13. The clamping bar guides 15 are mostly designed as linear guides in the various different embodiments. Said additional clamping bar 16 can also be referred to as a press bar, which is guided displaceably on the machine frame 7 relative to the latter. On opposite end faces 17, 17 of the two clamping bars 13, 16 which are parallel to one another clamping jaw mounts 19, 20 are arranged for fitting with the clamping tools 4. The clamping tool or tools 4 can also be held with the interconnection of an adapter, not shown in more detail, on the clamping jaw mounts 19, 20.

The shown bending press 3 comprises as a drive arrangement 21 for the adjustable upper clamping bar 16, namely the pressure bar, e.g. two drive means 22 operated with electrical power, which are line connected to a control device 24 supplied by a power network 23. The operation of the bending press 3 can be controlled by means of an input terminal 25 which is line-connected to the control device 24 for example.

The drive means 22 preferably consist of electric motor driven spindle drives 26, as generally known, by means of which adjusting means 27 for a reversible adjusting movement of the upper clamping bar 16 formed by the pressure bar are drive-connected to the latter for example.

Further details necessary for the operation of such a bending press 3, such as for example safety devices, stop arrangements and/or control devices, are not described in the present description to prevent it being unnecessarily long.

Furthermore, the production facility 1 can also comprise a manipulator 28, shown here in simplified form in FIG. 2, which manipulator removes from a schematically indicated supply stack 29 of metal sheets to be shaped or bent at least one piece and moves it into the operating area of the bending press 3. The manipulator 28 comprises a gripper 30 shown in simplified form, which in turn comprises gripping fingers 31, 32. The gripping fingers 31, 32 each comprise clamping surfaces on the side facing the workpiece 2 to be produced. By suitably pivoting the two gripping fingers 31, 32 relative to one another and applying a sufficient clamping force from the interaction of the clamping surfaces the metal sheet or the workpiece 2 to be produced is held by the manipulator 28 and moved accordingly and positioned between the opened clamping jaws 5, 6. By means of the gripping fingers 31, 32 of the gripper 30 a corresponding grip and then, according to the clamping movement, a sufficient hold for the workpiece 2 to be produced from the metal sheet is ensured.

Furthermore, it is shown here in a simplified manner that the two clamping bars 13, 16, in particular their tool mounts 19, 20, or the clamping tool 4 held thereon with its upper and lower clamping jaws 5, 6, when viewed in longitudinal direction of the clamping bars 13, 16 can define an adjusting plane 33 extending between the latter. The adjusting plane 33 runs preferably centrally relative to the clamping bar 13, 16 or the clamping jaw mounts 19, 20 arranged on the latter. In the present example embodiment a vertically aligned plane is used.

The two clamping jaws 5, 6 form a clamping area 34 between them at facing ends. Facing lower and upper clamping surfaces 35, 36 of the two clamping jaws 5, 6 are preferably aligned at right angles to the adjusting plane 33. An additional bearing table with a bearing surface can be arranged in the region of the front side of the bending press 3, but is not shown in more detail. The bearing surface can be arranged in the same plane as the lower clamping surface 35 of the lower clamping jaw 5. The latter is used with larger area metal sheets as an additional support in order to avoid unintentional folding particularly in the case of thin metal sheets.

A bending area 37 is defined as the area which is used to form from the mostly flat, still unformed metal sheet the workpiece 2 to be produced or to further process an already preformed workpiece 2, in that at least one additional bend is performed.

The bending area 37 is arranged mostly spaced apart from the adjusting plane 33 and is formed by end sections of at least one of the two clamping jaws 5 and/or 6. In the present example embodiment the bending area 37 is arranged on the side of the clamping bar 13, 16 facing away from the manipulator 28 or operator. Thus inside the machine frame 7.

The bending area 37 mostly forms on the workpiece 2 to be produced a preferably linear bending line, wherein on both sides of the latter limbs are formed as a result of the bending process. Depending on the desired geometry of the workpiece 2 to be produced the two limbs enclose a bending angle between them. Said bending angle is measured in a reference plane aligned perpendicular to the bending line. The reference plane in turn is also preferably aligned to be perpendicular to the adjusting plane 33.

In should be mentioned that the machine frame 7 of the bending press 3 is only shown in a very simplified form, whereby it is also possible to use different embodiments of the latter. Thus, for example the machine frame 7 or the machine body could be designed with a free upright passage. In this case the clamping jaw mounts 19, 20 would be mounted between the side walls 9, 10 or side parts. In a different configuration of the machine frame 7 or the machine body it is not possible to have a free upright passage, whereby the clamping jaw mounts 19, 20 cannot be mounted between the side walls 9, 10 or side parts.

To perform the bending process the bending press 3 of the production facility 1 also comprises a bending unit 38, which can also be denoted as a bending unit. This is indicated in a simplified form in FIG. 2 and can be adjusted in a bending tool-adjusting plane 39 aligned preferably parallel to the adjusting plane 33 relative to the machine frame 7. To provide a better overview the bending unit 38 and its components are not shown in the Figure.

The metal sheet which is prepositioned and clamped between the two clamping jaws 5, 6 can be reshaped, in particular bent, to form the workpiece 2 by means of a bending process, in particular a folding process, along the bending line forming the bending area 37.

Depending on the bending to be performed on the metal sheet clamped between the clamping jaws 5, 6 to produce the workpiece 2 either the lower clamping jaw 5 or the upper clamping jaw 6 forms the bending area 37. Thus the lower clamping jaw 5 forms a first forming edge or comprises the latter. The upper clamping jaw 6 forms a second forming edge or comprises the latter.

The at least one lower clamping jaw 5 comprises a lower clamping surface 35 on its end section facing the upper clamping jaw 6. The at least one upper clamping jaw 6 has an upper clamping surface 36 on its end section facing the lower clamping jaw 5. In a position bearing against one another the two clamping surfaces 35, 36 define a workpiece bearing plane 40 for the workpiece 2 to be produced.

The bending unit 38 comprises a bending tool 41 which comprises a bending edge 42. The bending tool 41 is arranged on a bending bar 43, wherein the bending bar 43 can be adjusted on bending bar guides 44 designed as linear guides by means of a bending bar drive 45 relative to the machine frame 7. Furthermore, the bending tool 41 can be pivoted about a pivot axis 46 aligned parallel to one of the forming edges. In principle, a central axis and not a physical component is defined as the pivot axis. The different components forming the pivot axis are described in more detail in the following.

The bending bar guides 44 are preferably arranged or formed in the region of the two side walls 9, 10 and are thus spaced apart from one another in the direction of the bending area 37 or the forming edges. The bending bar 43 is guided on the bending bar guides 44 on its end sections also spaced apart from one another in the direction of the bending area 37 or the forming edges. In this way behind the two clamping jaws 5, 6 sufficient free space is created for the workpiece 2 to be produced. By means of the vertical adjustability of the bending bar 43 thus a large operating area can be created for the limb of the workpiece 2 to be created to be bent, as prior to commencing the reshaping process no bending bar 43 with the bending tool 41 is arranged directly in the region of the workpiece bearing plane 40 behind the clamping jaws 5, 6. Prior to commencing the bending and/or folding process the bending bar 43 is located either above or below the workpiece bearing plane 40.

The bending unit 38 with the clamping jaws 5, 6 clamping the workpiece 2 to be produced is described in more detail in the following FIG. 3.

In the present description the following alignment is selected as the coordinate system or coordinate direction in bending presses 3. The X-coordinate represents the insertion direction of the metal sheet to be reshaped and is aligned at right angles to the adjusting plane 33. The Y-coordinate represents the vertical direction and is aligned at right angles to the workpiece bearing plane 40. Lastly, the Z-coordinate is aligned in the direction of the bending area 37.

Figure 3:
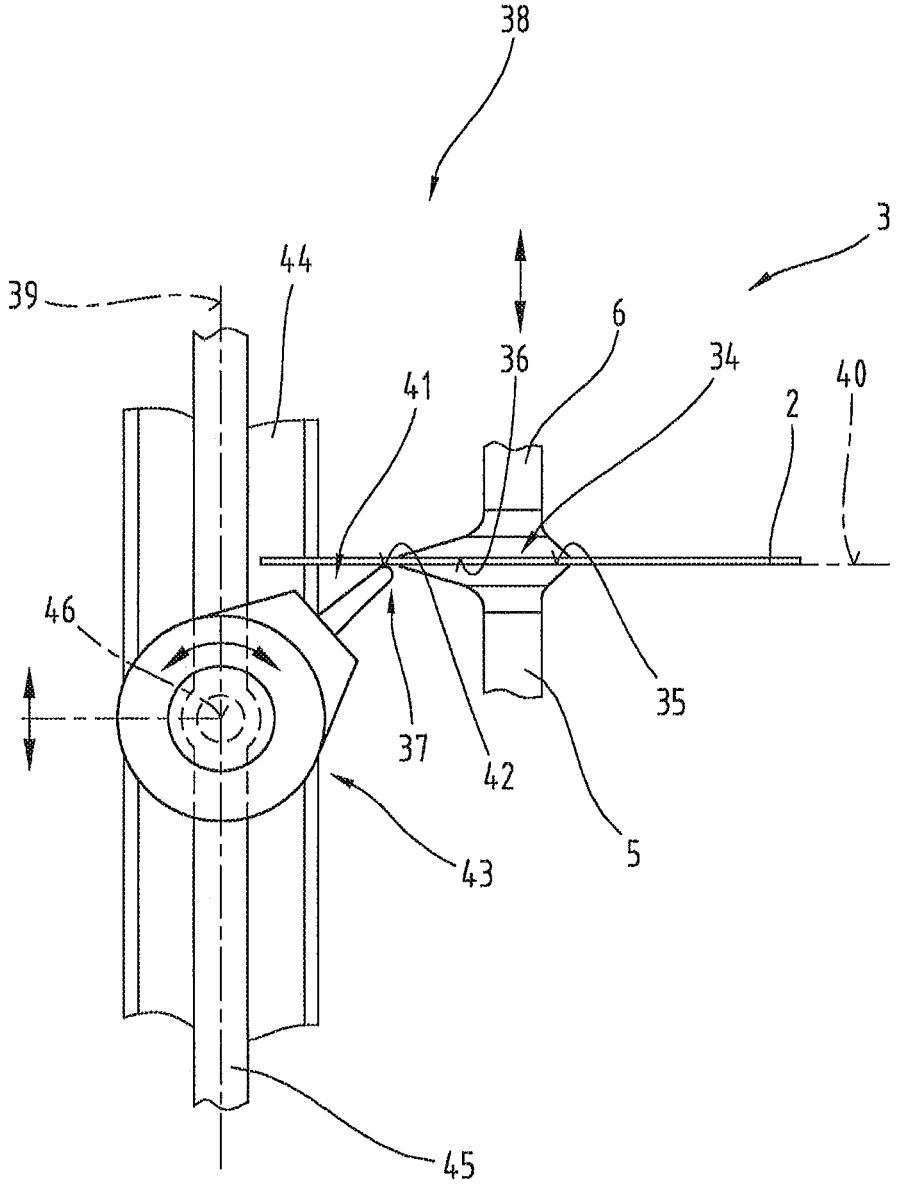
FIG. 3 shows a portion of the bending press with a heavily stylized bending unit, in side view.

FIG. 3 shows an embodiment of the bending unit 38, which if necessary is independent, wherein for the same parts the same reference numerals and component names have been used as for the preceding FIGS. 1 and 2. To avoid unnecessary repetition reference is made to the detailed description of the preceding FIGS. 1 and 2.

It should be mentioned that in the representation of the bending unit 38 the latter and its components have only been shown in a very schematic and stylized form. Furthermore, in this example embodiment the bending unit 38 is arranged on the side of the clamping jaws 5, 6 which faces away from the operator, who is not shown in more detail. The bending bar guides 44 are also spaced apart from one another, as viewed in the direction of the bending area 37. Between the latter the bending bar 43 extends with the bending tool 41 arranged thereon.

The bending bar guide 44 is preferably arranged in the region of the two side walls 9, 10, in order by the two clamping jaws 5, 6 between the bending bar guides 44 as viewed in longitudinal extension of the bending area 37 to provide unobstructed space for arranging the workpiece 2 or the metal sheet to be produced. The bending bar guide 44 can be formed by very different guiding units and/or guiding arrangements known from the prior art. It is essential to design an accurate linear guide for the bending bar 43. The bending bar guides 44 forming the guiding tracks are used to guide the bending bar 43 in an exact linear guide along the bending tool-adjusting plane 39 to perform an accurate bending process or folding process.

The selection of the bending bar drive 45 can also be performed according to the drive means known from the prior art. Here for example cylinder-piston arrangements, linear drives, traction drives or the like could be used.

The pivot axis 46 for the bending tool 41 defined by the bending bar 43 forms the central pivot base and/or the pivoting center point for the bending tool 41. The bending unit 38 comprises the bending tool 41, which can be pivoted about the pivot axis 46 into a different angular position relative to the latter as viewed in circumferential direction. Furthermore, the pivot axis 46 and thus the bending bar 43 can be displaced in a position located relative to the workpiece bearing plane 40 above the workpiece bearing plane 40 and also in a position located below the workpiece bearing plane 40. This is already indicated in a simplified form in FIG. 2.

In this way it is possible, depending on the folding process or the folding direction, to displace the bending tool 41 on the respective side of the workpiece bearing plane 40. As preferably the bending tool-adjusting plane 39 is aligned to be both parallel to the bending area 37 or parallel to one of the two forming edges of the clamping jaws 5 and/or 6 and also parallel to the adjusting plane 33, there is always a uniform horizontal distance over the whole vertical extension or vertical range of the bending tool-adjusting plane 39 between the latter and the bending area 37. Preferably, the workpiece bearing plane 40 is arranged or formed in a horizontal plane, whereby the bending tool-adjusting plane 39 is then preferably arranged at right angles thereto.

Regardless of the latter it would also be possible however to align or arrange the bending tool-adjusting plane 39 at an angle to but not at right angles to the workpiece bearing plane 40. In this way for example a different horizontal distance can be formed from the bending area 37 in the direction of the vertical extension of the bending tool-adjusting plane 39. In this way, by means of the oblique guiding of the bending bar 43 a more universal configuration and reshaping of the bending unit 38 can be achieved.

On the basis of the pivoting ability or rotatability of the bending tool 41 about the pivot axis 46 in this embodiment of the bending unit 38 with a single bending tool 41 a bending and/or folding process can be performed both in a direction above the workpiece bearing plane 40 and also in a direction below the workpiece bearing plane 40. If as a base or zero plane the workpiece bearing plane 40 is used, in Y-direction the pivot axis 46 can be adjusted both in minus-direction and in plus-direction.

Due to this pivoting ability or adjustability of the bending tools 41 about the pivot axis 46 thus the bending tool 41 can be aligned downwards in the direction of the first forming edge in a position of the pivot axis 46 located above the workpiece bearing plane 40 with its bending edge 42 facing the clamping jaws 5, 6. In this position the metal sheet or the workpiece 2 to be produced which is held in the clamping area 34 can be reshaped, in particular folded, in a position below the workpiece bearing plane 40.

If the bending tool 41 is adjusted with its pivot axis 46 into a position of the pivot axis 46 located below the workpiece bearing plane 40, when performing a corresponding adjusting and/or pivoting movement of the bending tool 41 its bending edge 42 facing the clamping jaws 5, 6 can be aligned upwards in the direction of the second forming edge. In this position by means of the same bending tool 41 the limb of the workpiece 2 to be bent can be reshaped in a position above the workpiece bearing plane 40.

In the present example embodiment according to FIG. 3 the bending bar 43 is designed as a physically supporting shaft. In this case the shaft defines the pivot axis 46 for the bending tool 41. Furthermore, the bending tool 41 can be connected in a rotationally secure manner to the shaft or can be coupled to the latter in a rotationally secure manner. In this way it is possible, when the shaft is drive-connected to a pivot drive, which is not shown in more detail, to pivot and/or rotate about the pivot axis 46 in its angled position. As the bending tool 41 can be coupled in a rotationally secure manner to the shaft or coupled to the latter in a rotationally fixed manner, by means of the pivot drive the alignment and position of the bending edge 42 can be adjusted to the respective folding and/or bending process to be performed.

By means of the bending bar guides 44 in this present example embodiment the shaft and thereby the bending bar 43 formed by the latter can be adjusted in a translatory adjustment movement in the bending tool adjusting plane 39. The additional rotational pivot movement and/or rotational movement of the bending tool 41 with its bending edge 42 is performed directly about the pivot axis 46. In the present example embodiment the rotary movement and/or pivot movement is/are transferred from the pivot drive to the shaft and then to the bending tool 41. With a corresponding, rotationally secure coupling and/or mounting it is thus possible to achieve a universal application of the bending unit 38.

If the position of the bending edge 42 and thereby the angular alignment of the bending tool 41 are adjusted relative to the workpiece bearing plane 40, then the reshaping process can be commenced, in the present example embodiment the bending and/or folding process. As already described above, prior to clamping the metal sheet for the workpiece 2 to be produced the bending bar 43 with the bending tool 41 is arranged either below the workpiece bearing plane 40 or above the workpiece bearing plane 40. Afterwards, the metal sheet for producing the workpiece 2 is inserted between the spaced apart clamping jaws 5, 6 and positioned accordingly. Afterwards the workpiece 2 to be produced is clamped between the clamping jaws 5, 6 of the bending press 3. In this position a limb of the workpiece 2 to be folded and/or bent is arranged projecting over the forming edges on the clamping jaws 5 and/or 6 in the direction of the bending tool 41. Afterwards the bending edge 42 of the bending tool 41 is aligned in the direction of one of the forming edges of the clamping jaws 5 and/or 6 according to the bending direction and/or folding direction to be performed. This alignment is performed by the previously described pivot movement of the bending tool 41 about the pivot axis 46 aligned parallel to at least one of the circumferential edges.

If this alignment and prepositioning of the bending edge 42 has been performed on the workpiece 2 to be produced, the bending tool 41 is adjusted by the longitudinal adjustment of the bending bar 43 along bending bar guides 44 of the bending unit 38 in the form of linear guides in the bending tool-adjusting plane 39 parallel to at least one of the forming edges in the direction of the workpiece 2 to be produced. This is performed until the bending edge 42 has been placed on and/or applied onto the surface of the workpiece 2 to be produced.

In this position the actual folding and/or bending process is performed. In this case there is a further adjustment of the bending tool 41 by means of the longitudinal adjustment of the bending bar 43 in the bending tool-adjusting plane 39 in the same adjusting direction. At the same time however the bending tool 41 can be pivoted about the pivot axis 46, in order to thus achieve the continued bearing of the bending edge 42 on the workpiece 2 to be produced. This simultaneous, in particular overlayered adjusting process the translatory adjustment movement and also the rotational adjustment movement are performed until the predefined bending angle is achieved on the workpiece 2 to be produced. By means of the simultaneous, overlayered adjusting and pivot movement thus a fixed bearing and/or rolling of the bending edge 42 of the bending tool 41 can be achieved on the surface of the workpiece 2.

In order to avoid the elastic springing back of the limb to be folded, it can still be advantageous if, when the predefined bending angle on the workpiece 2 to be produced has been reached, the adjustment movement of the bending tool 41 in the direction of the bending tool-adjusting plane 39 is stopped and there is a further pivoting of the bending tool 41 about the pivot axis 46. In this way overpressing can take place and after springing back the exact bending angle can be achieved.

If the bending tool 41 is connected in a rotationally secure manner to the shaft and/or coupled to the latter in a rotationally secure manner and the shaft is drive-connected to a pivot drive, the pivot drive can be designed such that the latter holds the shaft in position relative to its relative position about the pivot axis 46. By means of this fixed positioning of the bending tool 41 about the pivot axis 46 and thus its bending edge 42 it is possible to adjust one bending bar 43 in the bending bar guide 44 and thereby keep the distance between the bending edge 42 and the bending tool-adjusting plane 39 unchanged.

Furthermore, it can be advantageous if the pivot axis 46 is arranged in the bending tool adjusting plane 39 defined by the bending bar guides 44. In this way an eccentric or off-center arrangement of the pivot axis 46 relative to the bending bar guides 44 can be avoided.

Figure 4:
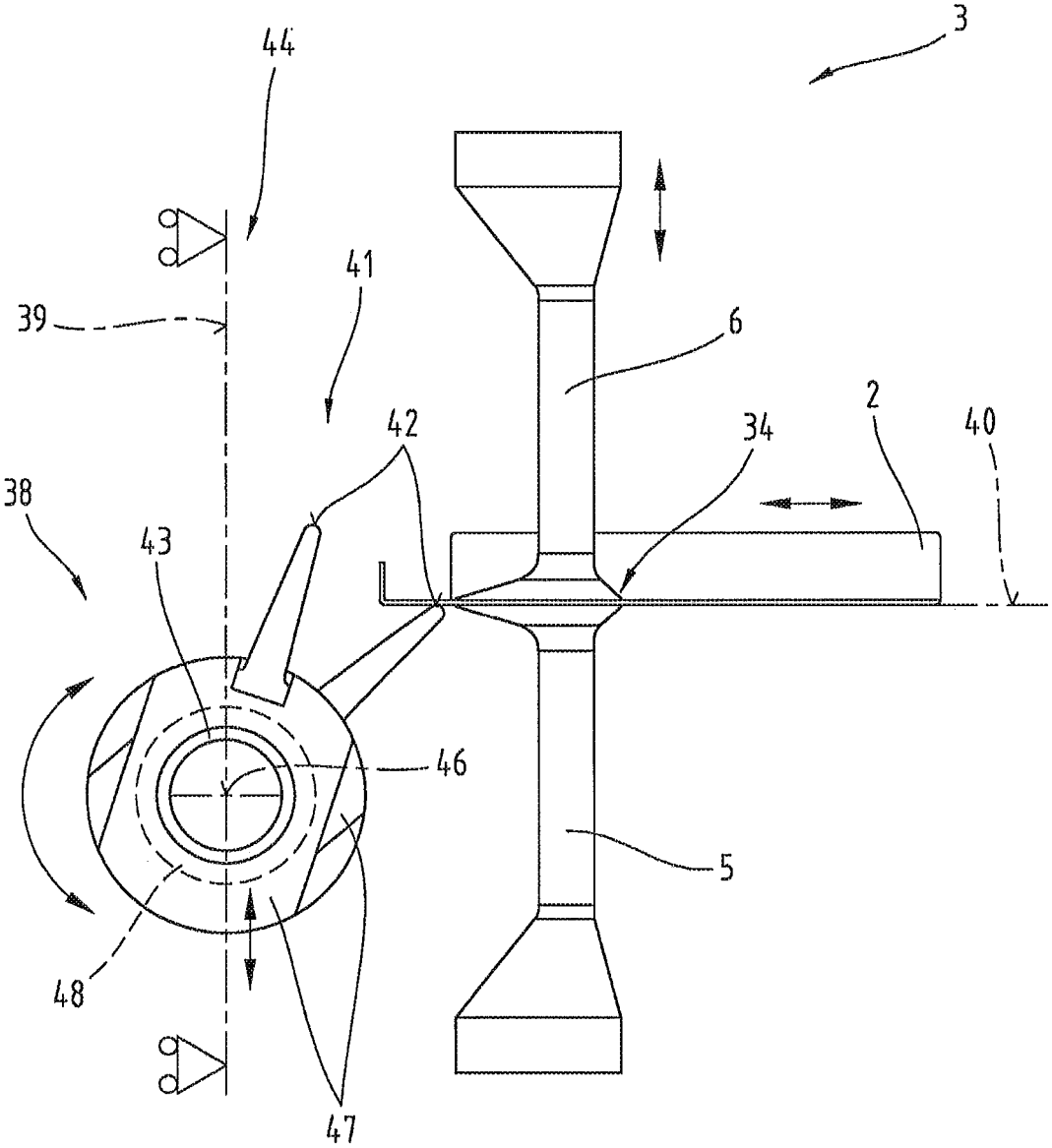
FIG. 4 shows a portion of another bending press with a heavily stylized bending unit, in side view.

In FIG. 4 an independent embodiment of the bending unit 38 is shown, in particular its bending tool 41, wherein for the same parts the same reference numerals and components names have been used as in the preceding FIGS. 1 to 3. To avoid unnecessary repetition reference is made to the detailed description of the preceding FIGS. 1 to 3.

In order to achieve a better and more individual adjustment of the bending tool 41 to different bending processes, in particular folding processes, it can be advantageous, if the bending tool 41 comprises a plurality of bending tool elements 47 arranged behind one another in longitudinal extension of the pivot axis. In this way it is possible to adjust the length of the used bending edge 42 of the bending tool 41 to the respective length of the bending area 37, by arranging a plurality of bending tool elements 47 one behind the other.

In this case it is advantageous, if the bending tool elements 47 are connected in different angular positions relative to one another to the shaft in a rotationally secure manner or are coupled to the latter in a rotationally secure manner. By selecting the different angular positions relative to one another some of the bending edges 42 can be used for the bending process, but bending tool elements 47 arranged adjacent to one another cannot be moved into contact with the workpiece 2 to be produced.

Independently of this it would also be possible however that the bending bar 43 itself is designed as a supporting axis and not as a supporting shaft. The axis is held on the bending bar guide 44 in a rotationally secure manner and can be adjusted itself in the bending tool-adjusting plane 39 by the bending bar drive 45, as already described above for the shaft.

If the bending tool 41 is made from individual bending tool elements 47, at least some of the bending tool elements 47 can be drive-connected respectively to a separate adjusting drive 48. In this way it is possible to individually displace the individual bending tool elements 47 relative to the pivot axis 46 about the latter on the supporting axis in rotatory adjustment movement relative to one another. Thus for example the at least one adjusting drive 48 can be arranged between the supporting axis and the respective bending tool element 47. The adjusting drive 48 is indicated in a simplified manner by dashed lines and can be formed by various different adjusting means and/or drive means. To provide a better overview the power supply and additional drive details have not been shown.

The exemplary embodiments show possible embodiment variants of the production facility 1, in particular its bending press 3, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Furthermore, also individual features or combinations of features from the shown and described different example embodiments can themselves represent independent solutions according to the invention.

The underlying objective of the independent solutions according to the invention can be taken from the description.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Mainly the individual embodiments shown in FIGS. 1, 2; 3; 4 can form the subject matter of independent solutions according to the invention. The objectives and solutions according to the invention relating thereto can be taken from the detailed descriptions of these figures.

Finally, as a point of formality, it should be noted that for a better understanding of the structure of the production facility 1, in particular its bending press 3, the latter and its components have not been represented true to scale in part and/or have been enlarged and/or reduced in size.

LIST OF REFERENCE NUMERALS

1 production facility
2 workpiece
3 bending press
4 clamping tool
5 lower clamping jaw
6 upper clamping jaw
7 machine frame
8 base plate
9 side wall
10 side wall
11 transverse bracing
12 front end face
13 clamping bar
14 front end face
15 clamping bar guide
16 clamping bar
17 end face
18 end face
19 clamping jaw mount
20 clamping jaw mount
21 drive arrangement
22 drive means
23 power network
24 control device
25 input terminal
26 spindle drive
27 adjusting means
28 manipulator
29 supply stack
30 gripper
31 gripping finger
32 gripping finger
33 adjusting plane
34 clamping area
35 lower clamping face
36 upper clamping face
37 bending area
38 bending unit
39 bending tool adjusting plane
40 workpiece bearing plane
41 bending tool
42 bending edge
43 bending bar
44 bending bar guide
45 bending bar drive
46 pivot axis

47 bending tool element
48 adjusting drive

The invention claimed is:

1. A method for reshaping a metal sheet into a workpiece (2), by using a bending press (3), comprising the following steps:

arranging a bending unit (38) spaced apart laterally by clamping jaws (5, 6) of a bending press (3), wherein the bending unit (38) comprises a bending tool (41) which is arranged on a bending bar (43) and is pivotable about a pivot axis (46), and the bending bar (43) supporting the bending tool (41) is designed to be displaceable exclusively on bending bar guides (44) designed as linear guides along a bending tool adjusting plane (39) both into a position located relative to a workpiece bearing plane (40) above the workpiece bearing plane (40) and into a position located underneath the workpiece bearing plane (40) and where either the pivot axis (46) and a bending edge (42) of the bending tool (41) can be arranged above the workpiece (2) to be produced or the pivot axis (46) and the bending edge (42) of the same bending tool (41) below the workpiece to be produced, clamping the workpiece (2) to be produced between the clamping jaws (5, 6) of the bending press (3), whereby a limb of the workpiece (2) to be bent is arranged on the bending tool (41) projecting over forming edges formed on the clamping jaws (5, 6);

aligning the bending edge (42) of the bending tool (41) in the direction of the forming edges of the clamping jaws (5, 6) by a pivot movement of the bending tool (41) about the pivot axis (46) aligned parallel to at least one of the forming edges;

adjusting the bending tool (41) by means of the longitudinal adjustment of the bending bar (43) along bending bar guides (44) of the bending unit (38) designed as linear guides in the bending tool adjusting plane (39) aligned parallel to at least one of the forming edges in the direction of the workpiece (2) to be produced and thus placing the bending edge (42) on the workpiece (2) to be produced;

further adjusting the bending tool (41) in the bending tool-adjusting plane (39) in the same adjustment direction and simultaneously pivoting the bending tool (41) about the pivot axis (46) until a predetermined bending angle is reached on the workpiece (2) to be produced.

2. The method as claimed in claim 1, wherein when reaching the predetermined bending angle on the workpiece (2) to be produced the adjustment of the bending tool (41) in the bending tool-adjusting plane (39) is stopped and a further pivoting of the bending tool (41) is performed about the pivot axis (46).

3. The method as claimed in claim 1, wherein the bending bar (43) is designed as a supporting shaft and the bending tool (41) is arranged on a supporting shaft, wherein the pivot axis (46) for the bending tool (41) is defined by the shaft.

4. The method as claimed in claim 3, wherein the bending tool (41) is connected in a rotationally secure manner to the shaft or coupled to the latter in a rotationally secure manner.

5. The method as claimed in claim 3, wherein the shaft is drive-connected to a pivot drive.

6. A bending press (3) for reshaping a metal sheet into a workpiece (2), comprising a fixed machine frame (7), a lower clamping bar (13) with at least one lower clamping jaw (5) mounted thereon, wherein at least one a lower clamping jaw (5) comprises a first forming edge, an upper clamping bar (16) with at least one upper clamping jaw (6) mounted thereon, wherein at least one upper clamping jaw (6) has a second forming edge, wherein the upper clamping bar (16) is adjustable on a clamping bar guide (15) by means of a drive arrangement (21) relative to the machine frame (7), in order to clamp the workpiece (2) to be produced between the two clamping jaws (5, 6), and the at least one lower clamping jaw (5) at its end section facing the upper clamping jaw (6) comprises a lower clamping surface (35) and the at least one upper clamping jaw (6) at its end section facing the lower clamping jaw (5) comprises an upper clamping surface (36), wherein the two clamping surfaces (35, 36) in a position bearing against one another define a workpiece bearing plane (40) for the workpiece (2) to be produced, a bending unit (38) with a bending tool (41), which comprises a bending edge (42), and the bending tool (41) is arranged on a bending bar (43), wherein the bending bar (43) can be adjusted on bending bar guides (44) designed in the form of linear guides by means of a bending bar drive (45) relative to the machine frame (7), and the bending tool (41) can be pivoted about a pivot axis (46) aligned parallel to one of the forming edges, wherein the bending bar (43) supporting the bending tool (41) is displaceable exclusively on bending bar guides (44) in the form of linear guides along a bending tool adjusting plane (39) both into a position located relative to the workpiece bearing plane (40) above the workpiece bearing plane (40) and into a position located underneath the workpiece bearing plane (40) and also the pivot axis (46) of the bending tool (41) can be moved into a position located both relative to the workpiece bearing plane (40) above the workpiece bearing plane (40) and also a position located underneath the workpiece bearing plane (40), and thereby the bending tool (41) in a position of the pivot axis (46) located above the workpiece bearing plane (40) with its bending edge (42) facing the clamping jaws (5, 6) is aligned downwards in a direction of the first forming edge and the same bending tool (41) in a position of the pivot axis (46) located below the workpiece bearing plane (40) with its bending edge (42) facing the clamping jaws (5, 6) is aligned upwards in a direction of the second forming edge.

7. The bending press (3) as claimed in claim 6, wherein the bending bar (43) is designed as a supporting shaft and the shaft defines the pivot axis (46) for the bending tool (41).

8. The bending press (3) as claimed in claim 7, wherein the bending tool (41) is connected in a rotationally secure manner to the shaft or coupled to the latter in a rotationally secure manner.

9. The bending press (3) as claimed in claim 7, wherein the shaft is drive-connected to a pivot drive.

10. The bending press (3) as claimed in claim 9, wherein the shaft is held in position by the pivot drive with regard to its relative position about the pivot axis (46).

11. The bending press (3) as claimed in claim 6, wherein the pivot axis (46) is arranged in a bending tool-adjusting plane (39) defined by the bending bar guides (44).

12. The bending press (3) as claimed in claim 6, wherein the bending tool (41) comprises a plurality of bending tool elements (47) arranged behind one another in the longitudinal extension of the pivot axis (46).

13. The bending press (3) as claimed in claim 12, wherein the bending tool elements (47) are connected in mutually different angular positions to the shaft in a rotationally secure manner or are coupled to the latter in a rotationally secure manner.

14. The bending press (3) as claimed in claim 6, wherein the bending bar (43) defines a supporting axis and at least some individual bending tool elements (47) are drive-connected to an adjusting drive (48) respectively.

15. The bending press (3) as claimed in claim 14, wherein the at least one adjusting drive (48) is arranged between the supporting axis and the at least one bending tool element (47).

16. The bending press (3) as claimed in claim 6, wherein the bending bar (43) of the bending unit (38) is guided in its spaced apart end sections on the bending bar guides (44) arranged spaced apart from one another in the direction of the forming edges.

* * * * *